US005529587A

United States Patent [19]

Diver

[11] Patent Number: 5,529,587

[45] Date of Patent: Jun. 25, 1996

[54] FLUIDIZED OXYDESULFURIZATION OF COAL

[76] Inventor: John R. Diver, 868 Larchmont La., Lake Forest, Ill. 60045

[21] Appl. No.: 214,790

[22] Filed: Mar. 16, 1994

Related U.S. Application Data

[63] Continuation of Ser. No. 38,465, Mar. 29, 1993, abandoned.

[51] Int. Cl.[6] ..... C10L 9/06; C10L 9/08

[52] U.S. Cl. ..... 44/625; 44/622; 44/629

[58] Field of Search ..... 44/622, 626, 629, 44/505, 625, 624

[56] References Cited

U.S. PATENT DOCUMENTS

| | | | |
|---|---|---|---|
| 3,909,212 | 9/1975 | Schroeder | 44/622 |
| 4,013,426 | 3/1977 | Schroeder | 44/627 |
| 4,118,201 | 10/1978 | Yan | 44/622 |
| 4,329,156 | 5/1982 | Othmer | 44/625 |
| 4,486,959 | 12/1984 | Chang | 44/280 |
| 4,681,598 | 7/1987 | Godbold et al. | 44/505 |
| 5,036,013 | 7/1991 | Wood et al. | 44/620 |

OTHER PUBLICATIONS

Coal Desulfurization Prior to Combustion, Eliot Chemical Technology Review No. 113, Pollution Technology Review No. 45 1978.

*Primary Examiner*—Margaret Medley
*Attorney, Agent, or Firm*—Carol M. Nielsen; Lee, Mann, Smith, McWilliams, Sweeney & Ohlson

[57] ABSTRACT

The method of the subject invention comprises a method and apparatus for removing sulfur in coal prior to combustion. In a fluid bed reactor, coal particles pass through a gaseous medium of air and superheated steam in a fluidized state under pressure. A continuous spray of atomizing water forms an aqueous thin film on the coal particles moving in the fluid bed. The thin aqueous film oxides the sulfur compounds contained within the coal. Usable coal is discharged from the fluid bed reactor as a portion of the discharge gas is vented and a portion of discharge gas recycled.

21 Claims, 2 Drawing Sheets

FLUIDIZED OXYDESULFURIZATION OF COAL

This application is a continuation application of my application Ser. No. 08/038,465, filed Mar. 29, 1993, now abandoned.

BACKGROUND OF THE INVENTION

This invention is generally related to processes for removing sulfur from coal, and is specifically directed to a method and apparatus for removing sulfur from coal prior to combustion in a fluid bed of compressed air, superheated steam and recycle gases.

DESCRIPTION OF THE PRIOR ART

The Clean Air Act Congressional Mandate of 1995 has hastened the development of new ways to remove sulfur by-products from coal combustion processes. One common method of removing sulfur and sulfur by-products from combustible coal is to employ, after the coal is combusted, a conventional scrubbing operation of the emission gases, otherwise known as flue gas. Flue gas is typically treated at the duct temperature at the base of an emission stack. In the conventional scrubbing operation, the flue gas is saturated in an aqueous solution of lime prior to releasing gases into the atmosphere. Scrubbers are inefficient in terms of the gas work, or energy, expended to clean stack emissions. This type of method of sulfur removal often creates waste products that require further chemical treatment and special disposal.

One proprietary process for the capture of sulfur and sulfur by products from the flue gas of combustible sulfur coals purports to remove 75 percent of $SO_2$ in a dry process by using hydrated nahocile which contains primarily a dry lime or calcium oxide, CaO solution. The pores of the nahcolite are filled with water, the medium for oxidizing sulfur into sulfur free radicals. This particular method was designed for a four percent (4% ) sulfur coal at a flue gas rate of 321 pounds per hour. Here, the diffusion coefficient of sulfur dioxide in the aqueous solution was disclosed as:

$$D_{Lime} = \frac{0.75 \times 24 \frac{LB(SO_2)}{LB(Lime)}}{\left[ 0.08 \times \frac{LB(SO_2)}{LB(Lime)} - 0.06 \times \frac{LB(SO_2)}{LB(Lime)} \right]} = 300 \frac{LB(Lime)}{HR}$$

where:
$L$ = depth of pore
$d$ = diameter of pore $0.08 \frac{LB(SO_2)}{LB(Lime)}$ = concentration of $SO_2$ at pore mouth and $0.06 \frac{LB(SO_2)}{LB(Lime)}$ = average $SO_2$ concentration along depth of the pore Conversely, sulfur may be removed from coal prior to combustion either chemically with air and steam, or biochemically with microbial in a process commonly known as oxydesulfurization. Both chemical and biochemical methods are viewed as equivalent. Fundamentally, for sulfur to be removed, oxygen molecules must be made available to sulfur molecules residing within or on the surface of the coal. Since sulfur is found in coal in various forms, including inorganic, organic and elemental, several approaches have been tested over the years.

For example, it has been shown that sulfur may be removed from coal by mechanically stirring an aqueous slurry containing coal particles in an air bubbled autoclave at about 400° F. An autoclave by definition is a process using superheated steam under pressure. One particular method maintains a total operating pressure of about 1000 psia having about 10 atmospheres of oxygen partial pressure. The residence batch time is about one hour. This process purportedly removes enough sulfur from coal to meet current EPA air quality standards at an estimated cost of eight dollars per ton ($8.00/ton) of coal.

Another tested chemical process utilizing an aqueous slurry operates at about 750 psia having about seven atmospheres (7 ATM) of oxygen partial pressure. Here, again the process temperature is 400° F. and has a residence batch time of one hour. However, this method for removing sulfur requires the use of an ammonium hydroxide additive to remove sulfur incurring specifically in the form of pyrites and other inorganics, and elemental sulfur.

Other tested methods have utilized microbial in an aqueous solution to remove sulfur from coal. The microbial are hydrocarbon oxidizing bacteria cultured in various mixtures of mineral salts and are dissolved in distilled water. One tested method utilizes a vigorously aerated autoclave using superheated steam, operating at 200° F. temperature and having a total operating pressure of 150 psia. This process operates at 0.3 atmospheres (ATM) of oxygen partial pressure and has a residence time of about three (3) days. Here, the microbial remove sulfur from aliphatic coal in the form of pyrites and other inorganics, and elemental sulfur. Like other aqueous batch processes, this method produces a coal mixture that needs further treatment to, provide a coal useful for combustion.

To remove sulfur from coal prior to combustion, and with oxygen, it is well known that the rate limiting step of the reaction is the diffusion of $SO_2$ from its source in the pore structure of the coal to the ambient, or surrounding fluidizing media. It has been thought by investigators that organic compounds of sulfur, in particular, reside primarily within the pores of coal. And because of its very nature, oxydesulfurization of coal requires water containing the normal concentration of $OH^-$, otherwise known as the hydroxyl ions, to be in contact with a sulfur compound, in order for oxidation of the sulfur to take place.

When evaluating the efficiency of diffusing sulfur dioxide from an aqueous solution sustained within coal pores, the coal pore structure and other diffusion parameters may be assumed similar to that of lime. Hence, if $SO_2$ diffusion reverses from the direction into a pore structure, such as lime in a scrubbing operation, to out of a pore structure, such as in an oxydesulfurization process, the diffusion coefficients of coal and lime may be considered equal.

Furthermore, as defined in the *International Chemical Handbook*, the diffusion coefficient of SO2 in an aqueous solution at 25° C. have been given as:

$$J, \frac{LB(SO_2)}{HR} = -D_{Coal} \frac{LB(Coal)}{HR} \left[ C_{Mouth} - C_{Average\ Depth} \right] \frac{LB(SO_2)}{LB(Coal)}$$

Where:

L=direction of diffusion;

J=$SO_2$ diffusion flux normal to L=direction; and

C=$SO_2$ concentration in pore water at pore mouth and along pore depth, respectively.

Therefore, if $SO_2$ concentration is increased by a factor of ten (10), and uses a 10 percent (10%) air and steam makeup continuously added to the four percent (4%) sulfur/coal feed of 321 pounds per hour, the process yields:

$$24X, \frac{LB(SO_2)}{HR} = +300\frac{LB(Coal)}{HR}\left[\left(\frac{0.80}{X}\right)\frac{LB(SO_2)}{LB(Coal)} - 0.80\frac{LB(SO_2)}{LB(Coal)}\right]$$

This equation can be mathematically solved to be:

$X^2+10X-10=0$ $X=0.91$ (91%)

where X equals the fraction of sulfur in coal removed by SO2 diffusion out of pores in coal.

Hence, oxydesulfurization of coal using ten percent (10% ) continuous flow of makeup air and steam removes roughly 91 percent of total sulfur in the coal as shown in the comparative, calculation above. This is a substantial improvement over the purported sulfur removal of about 75 percent contained in flue gas and removed after combustion during a dry scrubbing operation.

With a few exceptions, most available tested methods of removing sulfur are conducted in aqueous, or wet, processes such as slurries. Hence, a large amount of waste product results, and the coal discharged after the removal of sulfur is not useful for combustion without further treatment. Moreover, available processes are inefficient in terms of energy required to remove the sulfur from coal. Notwithstanding, no method removes sulfur from coal prior to combustion in a dry environment.

Therefore, a need exists for a method for removing sulfur from coal prior to combustion which is efficient in terms of process gas work or energy consumption, minimizes the amount of waste discharge, and generates a coal discharge readily useful for coal combustion.

SUMMARY OF THE INVENTION

The present invention is a method and apparatus for removing sulfur from coal prior to combustion. The subject invention maintains a continuous flow of coal particles through a mixture of compressed air, superheated steam and recycled gas forming a fluidized bed. The method of the removing sulfur comprises the steps of preheating coal particles to a temperature between about 212° to 350° F., mixing superheated steam with air to form a gaseous mixture, fluidizing the coal particles in the gaseous mixture to form a fluid bed of coal particles flowing through the gaseous mixture, and spraying the fluidized bed with water to deposit an aqueous film containing the normal amount $OH^-$ or hydroxyl ions on the coal particles. The thin aqueous film formed on the coal particles oxidizes sulfur compounds within the coal and forms $SO_2$ free radicals. As a result of the method of the present invention, the $SO_2$ free radicals produced are oxidized sulfur molecules having an undefined structure and nature which may include numerous inorganic and organic, stable and unstable compounds of $SO_2$. The $SO_2$ free radicals diffuse from within the aqueous thin film, a portion of which are recycled and the other portion later neutralized and vented to the atmosphere.

The method of the subject invention features removing sulfur from coal in a fluid bed, otherwise commonly known as a fluid bed reactor. The apparatus of the present invention contains a fluid bed reactor which may operate as a counterflow or parallel flow reactor. As coal is fluidized, water is sprayed onto the fluidized bed, depositing an aqueous thin film on the coal particles. Because the method utilizes superheated steam well above saturation pressure and temperature, this method of removing sulfur is performed in a dry environment. The atomized water feed onto the fluid bed produces, at best, an incipient observable wetness for removing sulfur from the coal without volatilation or oxidation of the coal.

Hence, the present invention is a continuous flow process performed in a dry environment which removes a high concentration of sulfur from coal, minimizes waste neutralization following the reactor, and discharges coal in a form readily usable for fuel combustion without further treatment or processing.

It is an object and feature of the present invention to provide a novel method and apparatus for removing sulfur from coal prior to combustion.

It is a further object and feature of the present invention to provide an economical method for removing sulfur from coal in a dry environment maintaining coal that is useful for combustion, and conventional handling.

It is yet a further object and feature of the present invention to provide a fluid bed reactor suitable for removing sulfur from coal prior to combustion and without the agglomeration of coal.

These and other objects and features of the invention will be readily apparent from the accompanying drawings and detailed description of the preferred embodiment.

DETAIL DESCRIPTION OF THE PREFERRED EMBODIMENT

Figure 1:
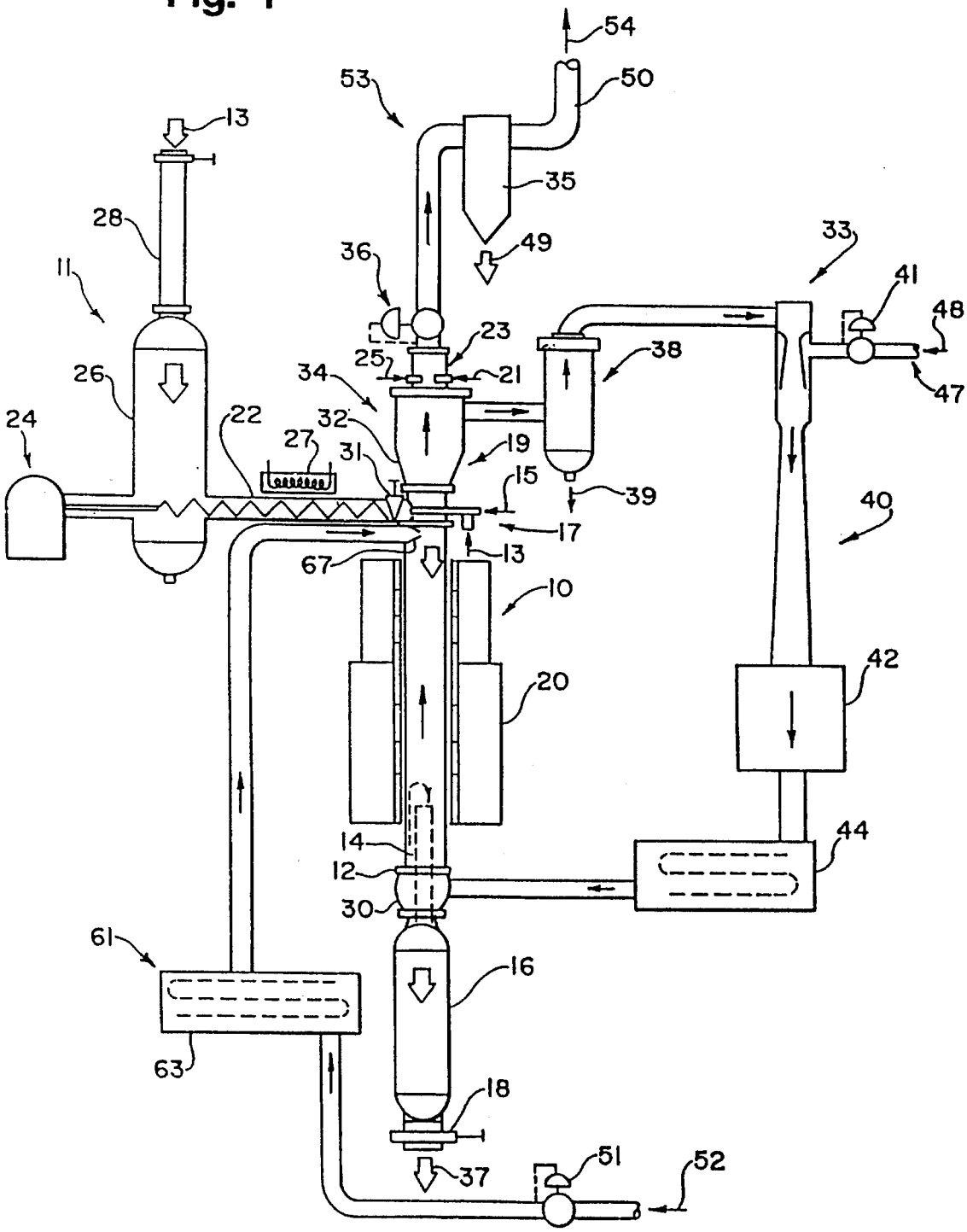
FIG. 1 is a schematic of the preferred embodiment of an apparatus for removing sulfur from coal according to the present invention.

The method of the subject invention comprises the steps of preheating coal particles to a temperature between about 212° to 350° F., mixing superheated steam with air to form a gaseous mixture, fluidizing the coal particles in the gaseous mixture to form a fluid bed of coal flowing through the gaseous mixture, and spraying the fluid bed with water to form a thin aqueous film on the coal particles for oxidizing and diffusing sulfur contained in the coal. The thin aqueous film formed on the coal particles oxidizes sulfur molecules to form $SO_2$ free radicals, or sulfur compounds having undefined structure and nature including inorganic or organic compounds of $SO_2$. The $SO_2$ molecules diffuse from the aqueous film, a portion of which are recycled and the other portion neutralized and vented to the atmosphere.

Coal is comminuted between about 1/16 to 1/4 inch in particle size having a preferred particle size of 6/32 inch. It is then heated and between about 212° to 350 ° F. The preferred coal temperature being at about 282° F.

Steam is superheated between about 212° to 525° F. at a pressure between about 200 to 750 psia and at a preferred temperature and pressure found to be about 510° F. at 247.31 psia (partial pressure). The superheated steam is mixed with recycle gas. Compressed air, about 500 psia, is then added to the steam and recycle gas at the same temperature and pressure, that is, between about 212° to 525° F. at a pressure between about 200 to 750 psia. Make up air is added in an amount resulting in between about 5 to 24 times the amount of steam plus recycle gas. The preferred air makeup quantity has been found at about 12 times or 1200 percent the amount of steam plus recycle gas versus the amount of compressed air in the fluidized bed reactor.

Coal is then fluidized in the gaseous mixture of compressed air, superheated steam and recycle gas. The fluid bed operates between about 125 to 250 psi of air, about 250 psi of steam at about 439° F. (20° superheat, or 20° F. above the dry adiabatic saturation line on the Molier Chart), with coal particles heated between about 212°–350° F. and having an oxygen partial pressure of between about 1.5 to 7.0 atmospheres (ATM). The preferred oxygen partial pressure being 3.7 atmospheres (ATM).

As the coal is fluidized in the reactor, it is quenched by the impact of atomized water sprayed in a humidifier to evaporatively cool the mixture having a process temperature of about 400° F. The method of the present invention does not overly oxidize or volatilize the coal. The aqueous film deposited on the coal particles has at least a 30 nanometers (n) minimum thickness. This minimum thickness will permit and force an aqueous oxydesulfurization. At most, the process of the subject invention has an incipient, observable wetness which does not agglomerate coal in the fluid bed reactor. On the other hand, the recommended maximum thickness of the aqueous film is 300 microns to prevent the coal from agglomerating. Moreover, one or more substances from a catalytic group consisting of microbial culture plus mineral salt, ammonium hydroxide and hydroxides of the alkaline earth metals may be added to the spray water to assist in the oxydesulfurization process.

The coal particles are fluidized in the gaseous mixture for one hour at constant temperature and pressure while pyritic, inorganic, organic and separated organic sulfur in the coal is oxydesulfurized. The sulfur is oxidized from the coal into the aqueous film layer forming sulfone and $SO_2$ free radicals. The $SO_2$ free radicals diffuse from throughout the coal particles into the gaseous mixture while in the fluidized state. It is believed the recycle gases enhance the concentration of the $SO_2$ free radicals.

After about an hour, desulfurized coal is discharged from the fluid bed reactor as clean coal and a portion of the gaseous mixture is vented and neutralized in one of many processes well known to those skilled in the art. The preferred method of neutralization is a conventional lime scrubbing operation where a small amount of gypsum byproduct must be disposed. The coal discharged from the fluid bed of the subject invention may be used for fuel combustion without further treatment or processing. The other portion of the gaseous mixture is recycled as recycle gas.

Figure 3:
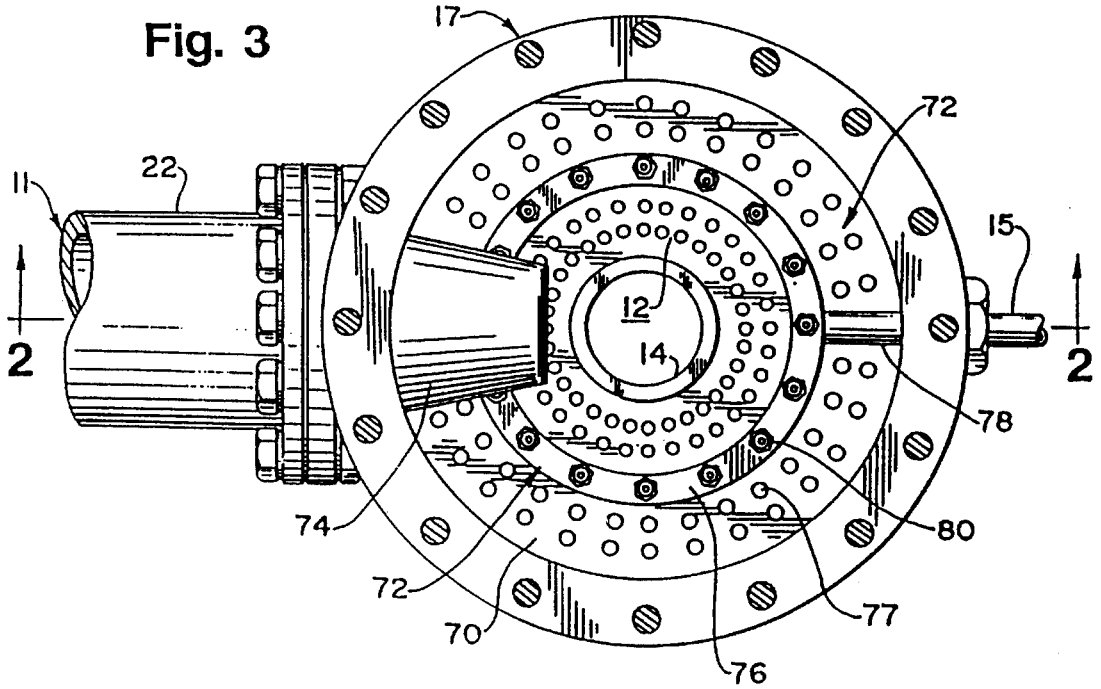
FIG. 3 is a horizontal cross-sectional view of the preferred means for depositing an aqueous film taken across 3—3 of FIG. 2.
Figure 2:
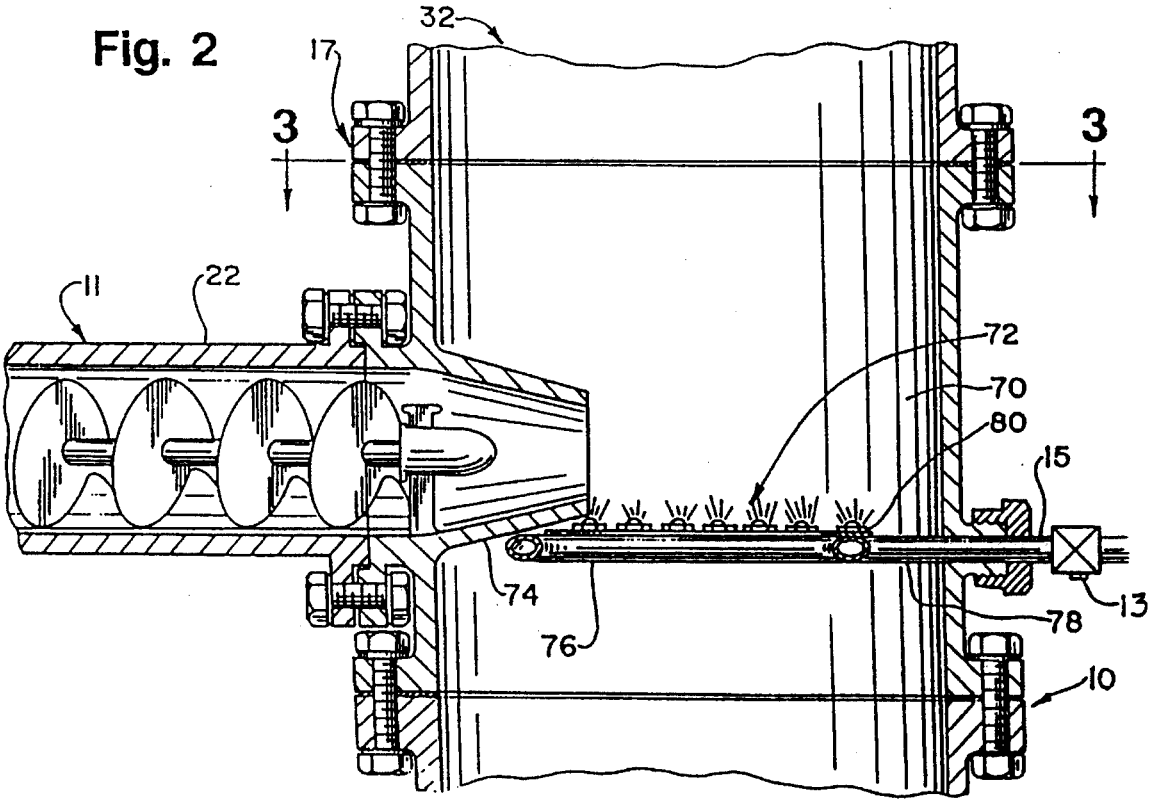
FIG. 2 is vertical cross-sectional view of the preferred embodiment of the means for depositing an aqueous film, and taken across 2—2 on FIG. 3.

FIGS. 1 through 3 represent the preferred embodiment of an apparatus for removing sulfur from coal prior to combustion according to the method of the subject invention. As shown in FIG. 1, the apparatus for removing sulfur from coal comprises a fluid bed reactor 10 for fluidizing coal particles in a gaseous mixture of compressed air, superheated steam and recycle gas and a means 17 for depositing an aqueous film onto the coal particles. The recycle gas consists essentially of air, superheated steam, coal particles and $SO_2$ free radicals. The means 17 for depositing an aqueous film is in operative relation to the fluid bed reactor 10. The fluid bed reactor 10 may be a parallel or counterflow fluid bed.

The fluid bed reactor 10 of the preferred embodiment comprises a compressed air intake 52 for providing compressed air to the fluid bed reactor 10, a superheated steam intake 47 for providing superheated steam to the fluid bed reactor 10, a coal particle intake 43 for providing coal particles to the fluid bed reactor 10, a means 40 for recycling discharge gas, a discharge gas outlet 50 and a coal discharge outlet 37 oppositely positioned from said coal particle intake 43.

As shown in FIG. 2, in the preferred embodiment, the means 17 for depositing an aqueous film onto coal particles comprises a cylindrical spray chamber 70 and a spray system 72. The cylindrical spray chamber 70 has an open top and open base (not shown) where the open base is bounded by the top of the fluid bed reactor 10. The open top of the chamber 70 is connected to a diffuser 32.

The spray system 72 is preferably, just below the nozzle 74. The nozzle 74 is connected to the coal intake 13 at one end and the means for feeding coal particles 11 at the other. The spray system 72 is connected to the water inlet 15 and centrally mounted within the spray chamber 70. As shown in FIG. 3, the preferred spray system comprises a circular ring 76 of concentrically mounted tubing having an extension 78 supported by the side wall of the chamber 70 and configured in a horizontal plane, and a plurality of atomizing spray nozzles 80 mounted on the top of the circular ring 76 pointing in the preferred embodiment in an upward direction. A booster tap 13 connects to the water intake 15 with a shut off valve (not shown). Also, not shown is an optional plurality of coal nozzles positioned within the coal feed means mounted on the sidewall of the chamber spaced in approximately equal circular pitch and directed for injection generally radially inwardly.

As shown in FIG. 1, the recycle means 40 of the fluid bed of the present invention comprises an ejector gas pump 33 and a heat exchanger 44. The recycle means 40 may also optionally include a gas filter 42 connected to the inlet or outlet of the ejector gas pump 33. The heat exchanger 44 will then connect to the filter 42. The ejector gas pump is of the type commonly known to those skilled in the art. In the preferred embodiment, the superheat intake 47 is connected to the means 40 for recycling discharge gas. As shown in FIG. 1, a pressure regulator valve 41 connected to the source 48 of superheated steam. The heat exchanger 44 is connected to a mixing plenum 30.

Also shown in FIG. 1 is the make-up air section 61 connecting to the fluid bed reactor 10 :near its top where an air nozzle 67 is located below the aqueous film depositing means 17. Preferably, a pressure regulator valve 51 is connected to the compressed air intake 52 for supplying the make-up air. An air cooler 63 is connected to the regulator valve 51.

In the preferred embodiment, a means for feeding coal particles 11 is connected to the coal particle intake 43 of the fluid bed reactor 10. As shown in FIGS. 1 and 2, the means 11 for feeding coal particles comprises a charging tube 28, an auger 22 connected to the fluid bed reactor 10 and a feed hopper 26 connected at one to the charging tube 28 and at the other end to the auger 22. The auger 22 may have a variable speed drive 24. Coal particles are supplied to the auger 22 from the feed hopper 26 by the charging tube 28.

A gate valve 31 opens and shuts the means 11 for feeding coal from the fluid bed reactor 10.

The fluid reactor 10 of the preferred embodiment also contains a mixing plenum 30 sealingly mounted around a standpipe 14. The plenum 30 opens upwardly into a distributor 12 at the bottom of the reactor 10. The standpipe 14 has a base (not shown) mounted on the distributor disk 12 just below the reactor 10 and stands up in the center of the reactor 10. The standpipe 14 extends into the reactor 10 preferably about 1 pipe diameter, leaving an upper portion above the reactor as free board 19. Preferably a plurality of heating elements 20 surrounds the reactor 10.

Also in the preferred embodiment, a diffuser section 32 mounted within the disengaging section 34 caps the fluid bed reactor 10. A knock out drum 38 is connected to the disengaging section 39. A drain shut off valve 39 connects to the bottom of the knock out drum 38.

A means 53 for neutralizing and biodegrading discharge gas may be connected to a disengaging section 34. Preferably, as shown in FIG. 1, the off-gas biodegrading/neutralizing means 53 comprises a discharge reactor 23 connected to a pressure regulator valve 36, a baghouse 35 and stack 50. The baghouse 35 has a gypsum discharge 49 and off gas discharge outlet 50, respectively. The discharge reactor 23 has a hydraulic diameter about 1/3 of the fluid bed reactor 10.

Coal is discharged from the fluid bed reactor 10 at a coal discharge outlet 37. In the preferred embodiment, a receiver 16 is mounted on the bottom of the mixing plenum 30 below the fluid bed reactor 10, and connected to the lower end of the standpipe 14. Preferably a slide valve 18 is mounted at the bottom of the receiver 16 for removing the clean coal particles.

The foregoing detailed description has been given only by way of example and it will be understood by those skilled in the art that many modifications may be made in the structure of the illustrated and described preferred embodiment without departing from the spirit and scope of the invention as herein after claimed.

I claim:

1. A method for removing sulfur from coal, comprising the steps of:

a. preheating coal particles to a temperature between about 212° to 350° F. wherein said coal particles are sized between about 1/16 to 1/4 inches;

b. mixing superheated steam with a recycle gas and compressed air at about 500 psia to form a gas mixture wherein the amount of steam and recycle gas is 5 to 24 times the amount of compressed air added, and the superheated steam has a temperature between 212° to 525° F. and a pressure between about 200 to 750 psia;

c. fluidizing the coal particles in the gaseous mixture to form a fluid bed of coal, the fluid bed of coal operating between about 125 to 250 psi of air, with about 250 psi of steam at about 439° F., with coal particles heated and having an oxygen partial pressure between about 1.5 to 7.0 atmospheres, the coal particles flowing through the gaseous mixture; and d. spraying the fluid bed of coal with atomized water to form an aqueous film of at least 30 nanometers thick on the coal particles for oxidizing the sulfur contained in the coal and to evaporatively cool the gaseous mixture to a process temperature of about 400° F.,

2. The method of removing sulfur from coal of claim 1, further comprising the step of:

e. discharging the gaseous mixture from the fluid bed to form a recycle gas consisting essentially of air, superheated steam coal particles and SO2 free radicals.

3. The method of claim 2 wherein a portion of the gaseous mixture is discharged from the fluid bed and chemically neutralized.

4. The method of removing sulfur from coal of claim 1 wherein the coal particles counter-flow through the gaseous mixture for about one hour.

5. The method of removing sulfur from coal of claim 1 wherein the coal particles flow in parallel with the gaseous mixture for about one hour.

6. The method for removing sulfur from coal of claim 1 wherein the aqueous film has a maximum thickness of 300 microns.

7. The method of claim 1 further comprising the step of mixing an oxydesulfurizing microbial culture additive with the water sprayed on the fluid bed.

8. The method of claim 1 further comprising the step of mixing an ammonium hydroxide additive with the water sprayed on the fluid bed.

9. The method of claim 1 further comprising the step of mixing a hydroxide of an alkaline earth metal with the water sprayed on the fluid bed.

10. An apparatus for removing sulfur from coal comprising:

a fluid bed reactor for fluidizing coal particles in a gaseous mixture of compressed air, superheated steam and recycle gases, said recycle gases consisting essentially of air, superheated stearn, coal particles and SO2 free radicals;

a compressed air intake for providing compressed air to said fluid bed reactor;

a coal particle intake for providing coal particles to said fluid bed reactor;

a means for recycling gas:

a discharge gas outlet;

a coal discharge outlet oppositely positioned from said coal particle intake; and a means for depositing an aqueous thin film onto the coal particles, said means for depositing comprising a cylindrical spray chamber and a spray system, said spray system comprising a circular ring having a plurality of atomizing spray nozzles.

11. The apparatus of claim 10 further comprising a coal discharge receiver, said receiver connected to said coal discharge outlet.

12. The apparatus of claim 11 further comprising a means for feeding coal particles, said means for feeding connected to said coal intake of said reactor.

13. The apparatus of claim 11 further comprising a mixing plenum, said plenum positioned between and connected to said fluid bed reactor and said receiver.

14. The apparatus of claim 13 wherein a distributor disk is connected to said mixing plenum and a standpipe is sealingly mounted on said disk, said standpipe extending into said fluid bed reactor.

15. The apparatus of claim 10 wherein said superheated steam intake is connected to said means for recycling gas.

16. The apparatus of claim 10 wherein said fluid bed reactor is a parallel flow reactor.

17. The apparatus of claim 10 wherein said fluid bed reactor is a counterflow reactor.

18. The apparatus of claim 10 further comprising a means for neutralizing the discharge gas, said neutralizing means connected to said discharge outlet of said fluid bed reactor.

19. The apparatus of claim 10 further comprising a means for biodegrading the discharge gas, said biodegrading means connected to said discharge outlet of said fluid bed reactor.

20. The apparatus of claim 12 wherein said means for feeding coal particles comprises a charging tube, an auger connected to said fluid bed reactor, and a feed hopper connected at one end to said charging tube and at the other end to said auger.

21. The apparatus of claim 13 wherein said superheated steam intake is connected to said means for recycling discharge gases, said recycle means connected to a knock out drum at one end and to said mixing plenum at the other, said knock out drum connected to said discharge gas outlet.

* * * * *